US006517051B1

(12) United States Patent
Cavanaugh

(10) Patent No.: US 6,517,051 B1
(45) Date of Patent: Feb. 11, 2003

(54) VEHICLE TIRE SAVER SYSTEM

(76) Inventor: Michael A. Cavanaugh, 18490 Burning Tree Ct., Tehachapi, CA (US) 93561

( * ) Notice: Subject to any disclaimer, the term of this patent is extended or adjusted under 35 U.S.C. 154(b) by 0 days.

(21) Appl. No.: 09/946,968

(22) Filed: Sep. 4, 2001

(51) Int. Cl.[7] ..... E02C 3/00
(52) U.S. Cl. ..... 254/88; 14/69.5
(58) Field of Search ..... 254/88, 94; 14/69.5; 248/188.2, 352; 188/32

(56) References Cited

U.S. PATENT DOCUMENTS 2,532,149 A * 11/1950 Cone ..... 254/88
3,661,229 A * 5/1972 Stonhaus ..... 254/88
4,108,421 A * 8/1978 Extine ..... 254/88
4,165,862 A * 8/1979 Bennett ..... 254/88
4,819,910 A * 4/1989 Johnston ..... 254/88
4,911,270 A * 3/1990 Hudson ..... 188/32
6,135,420 A * 10/2000 Johnston et al. ..... 254/88
6,230,446 B1 * 5/2001 Chalich ..... 248/188.2

* cited by examiner

*Primary Examiner*—Lee Wilson
(74) *Attorney, Agent, or Firm*—Joseph N. Breaux

(57) ABSTRACT

A vehicle tire saving system or device which includes blocks having a contoured surfaced sized and shaped to receive a particular size tire and evenly support an arched section of the tire to prevent crushing of the side wall of the tires during extended period of storage thereby eliminating or minimizing the occurrence of dry rot to the tires. The device or system could also be used as a jacking mechanism for tandem tire assemblies and as a stand system for elevating a portion of a vehicle while performing work such as changing the oil filter or the like.

1 Claim, 4 Drawing Sheets

VEHICLE TIRE SAVER SYSTEM

TECHNICAL FIELD

The present invention relates to vehicle tire accessories and more particularly to a vehicle tire saver system that is adapted for providing a contoured surface for the bottom section of a tire during storage periods to prevent dry rot of the tire; the tire saver device including an elevation block, an incline block, a contour block, and a ramp tip block; the contour block and ramp tip block having zig zag cut bottoms that are adapted to engage the zig zag cut top surface of the incline block; the elevation block including a ramped tip portion and a planar end surface having a number of pegs projecting upwardly therefrom that are adapted, spaced and sized to seat into a like number of apertures provided in the bottom of the incline block; the contour block being provided with a contoured tire seating surface that is sized and shaped for a particular size tire to provide an exact round fit for supporting the radial section of the tire uniformly to prevent disfigurement of the tire due to gravity and eliminate or minimize the detrimental effects of storage on the tire; the system can also be used as a quick and easy method for jacking up a tire on a tandem tire assembly or as a stand system for supporting the car in an elevated position for performing oil changes and/or lubrications.

BACKGROUND OF INVENTION

Storing a vehicle with tires for a length of time can be detrimental to the tires because the forces on the idle tire can cause the side walls of the tire to become brittle, cracked and misshaped by the heat and weight of the vehicle over an extended period of time. The condition is known as dry rotting and is irreparable and requires replacement of the tire. It would be a benefit, therefore, to have a vehicle tire saving device or system which would provide blocks having a contoured surface for evenly supporting a section of the weight bearing surface of the tire in a uniform manner to prevent compression of the tire and the dry rot which is associated with uneven prolonged compression of a particular portion of a tire.

SUMMARY OF INVENTION

It is thus an object of the invention to provide a vehicle tire saver system that is adapted for providing a contoured surface for the bottom section of a tire during storage periods to prevent dry rot of the tire; the tire saver device including an elevation block, an incline block, a contour block, and a ramp tip block; the contour block and ramp tip block having zig zag cut bottoms that are adapted to engage the zig zag cut top surface of the incline block; the elevation block including a ramped tip portion and a planar end surface having a number of pegs projecting upwardly therefrom that are adapted, spaced and sized to seat into a like number of apertures provided in the bottom of the incline block; the contour block being provided with a contoured tire seating surface that is sized and shaped for a particular size tire to provide an exact round fit for supporting the radial section of the tire uniformly to prevent disfigurement of the tire due to gravity and eliminate or minimize the detrimental effects of storage on the tire; the system can also be used as a quick and easy method for jacking up a tire on a tandem tire assembly or as a stand system for supporting the car in an elevated position for performing oil changes and/or lubrications.

Accordingly, a vehicle tire saver system is provided. The vehicle tire saver system is adapted for providing a contoured surface for the bottom section of a tire during storage periods to prevent dry rot of the tire; the tire saver device including an elevation block, an incline block, a contour block, and a ramp tip block; the contour block and ramp tip block having zig zag cut bottoms that are adapted to engage the zig zag cut top surface of the incline block; the elevation block including a ramped tip portion and a planar end surface having a number of pegs projecting upwardly therefrom that are adapted, spaced and sized to seat into a like number of apertures provided in the bottom of the incline block; the contour block being provided with a contoured tire seating surface that is sized and shaped for a particular size tire to provide an exact round fit for supporting the radial section of the tire uniformly to prevent disfigurement of the tire due to gravity and eliminate or minimize the detrimental effects of storage on the tire; the system can also be used as a quick and easy method for jacking up a tire on a tandem tire assembly or as a stand system for supporting the car in an elevated position for performing oil changes and/or lubrications.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
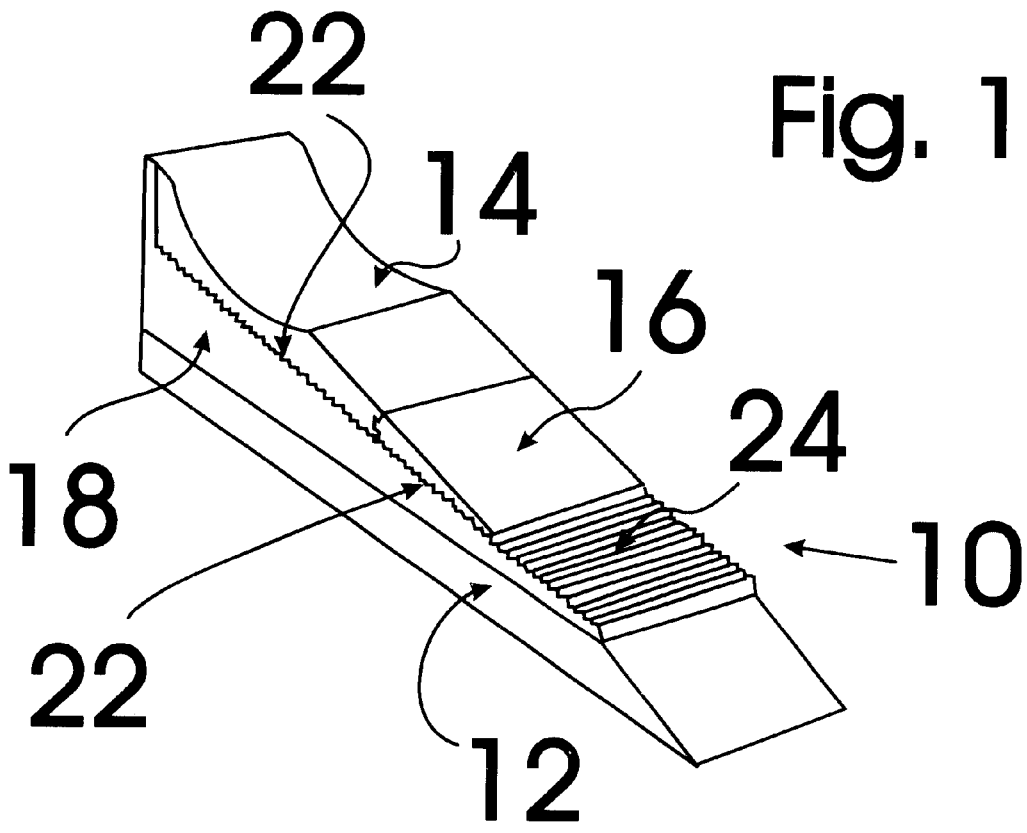
FIG. 1 is an exemplary embodiment of the tire saving system of the present invention.
Figure 2:
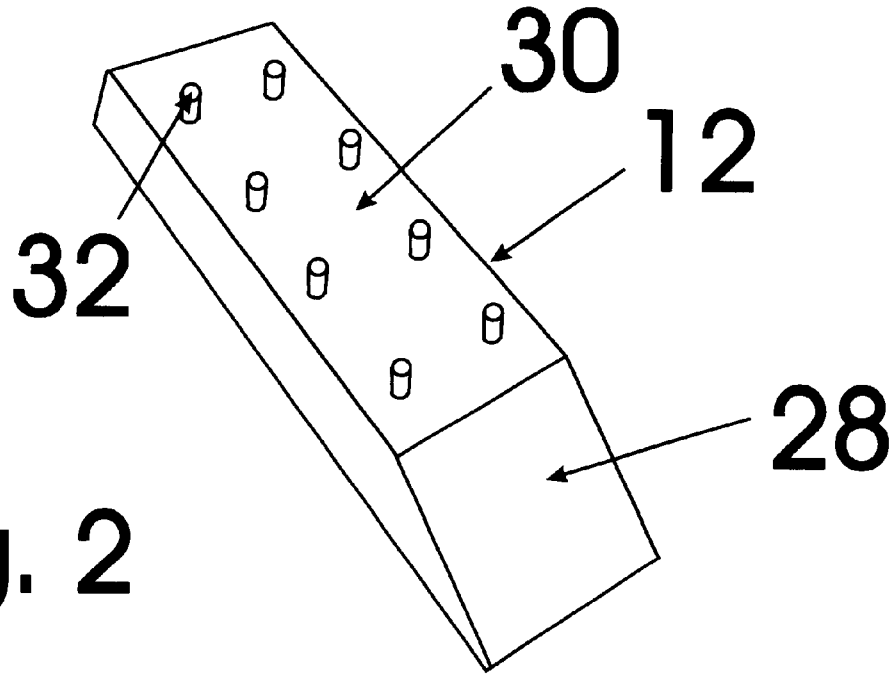
FIG. 2 is a perspective view of the support block of the system of the present invention.
Figure 3:
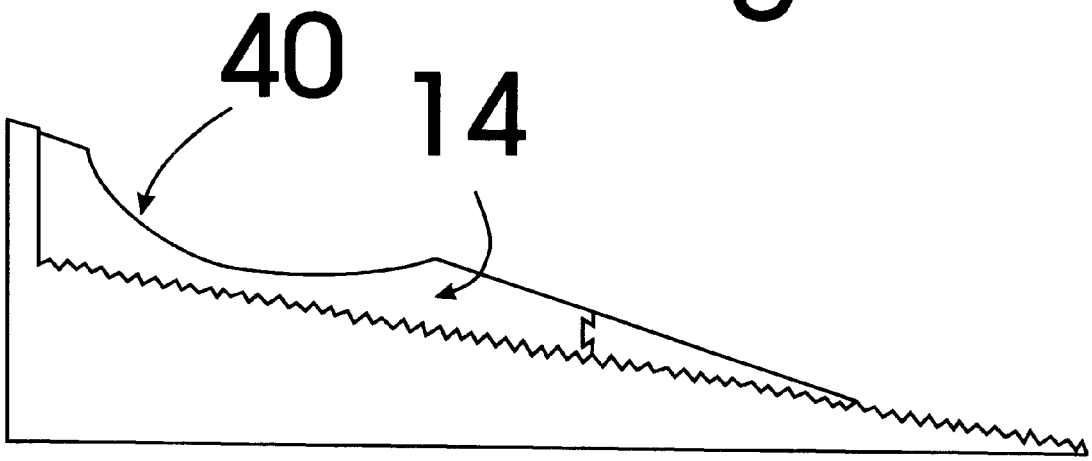
FIG. 3 is a side plan view of the support system of the present invention.
Figure 4:
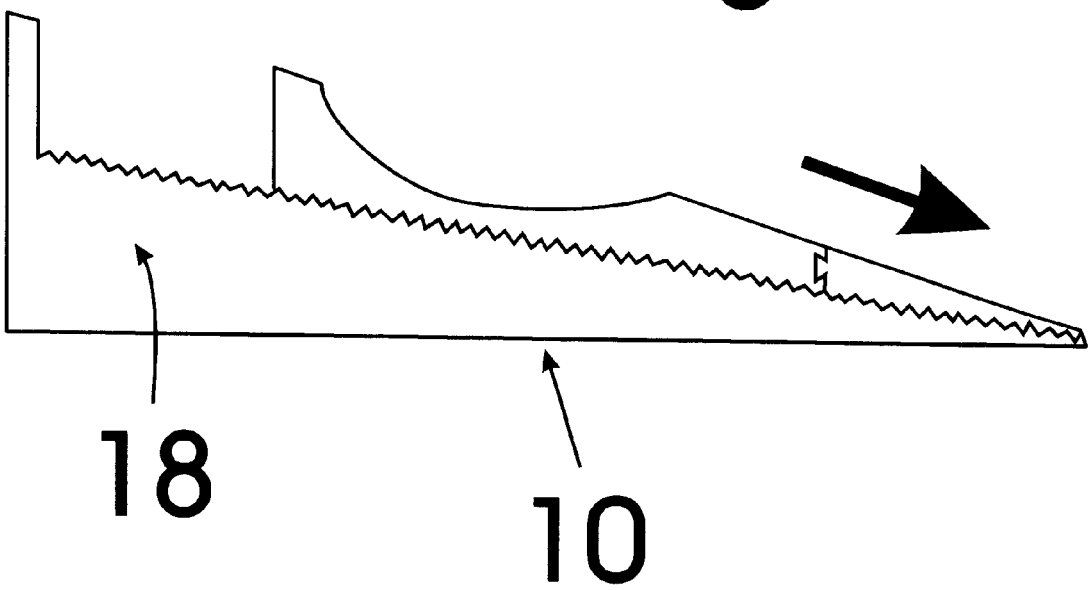
FIG. 4 is a second side plan view of the support system of the present invention.
Figure 5:
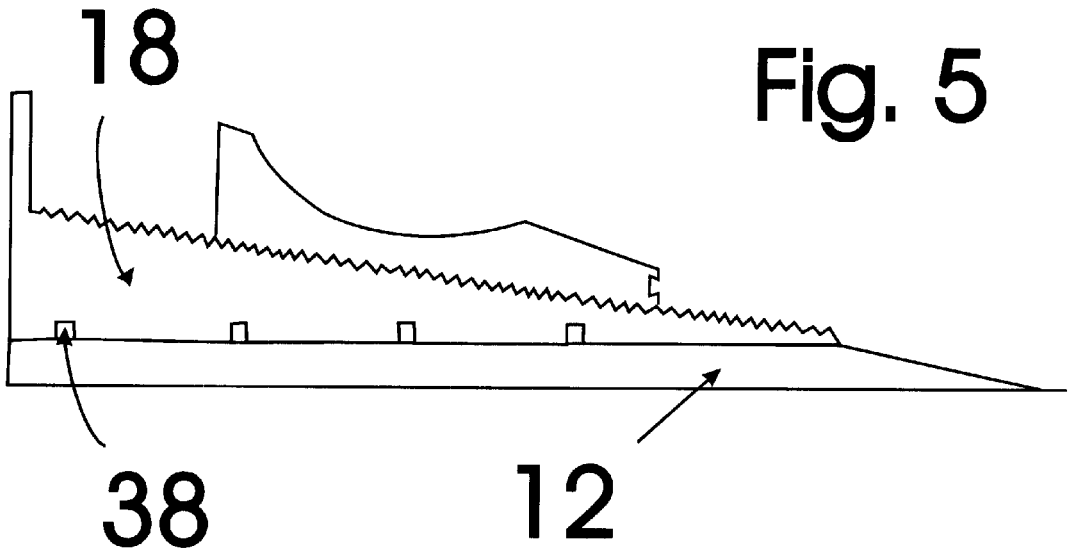
FIG. 5 is a third plan view of the support system of the resent invention.
Figure 6:
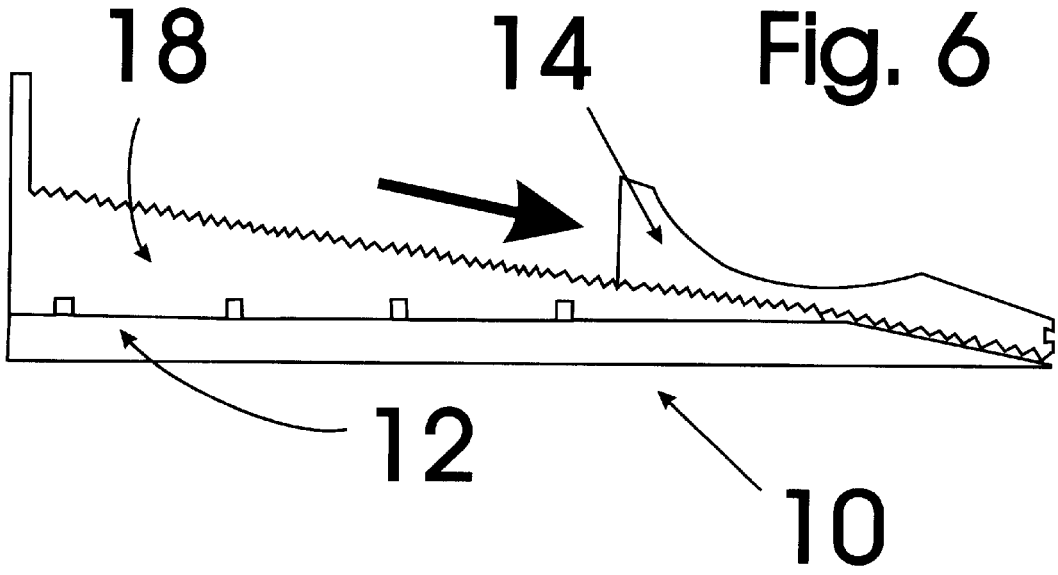
FIG. 6 is a forth plan view of the tire support system of he present invention.
Figure 7:
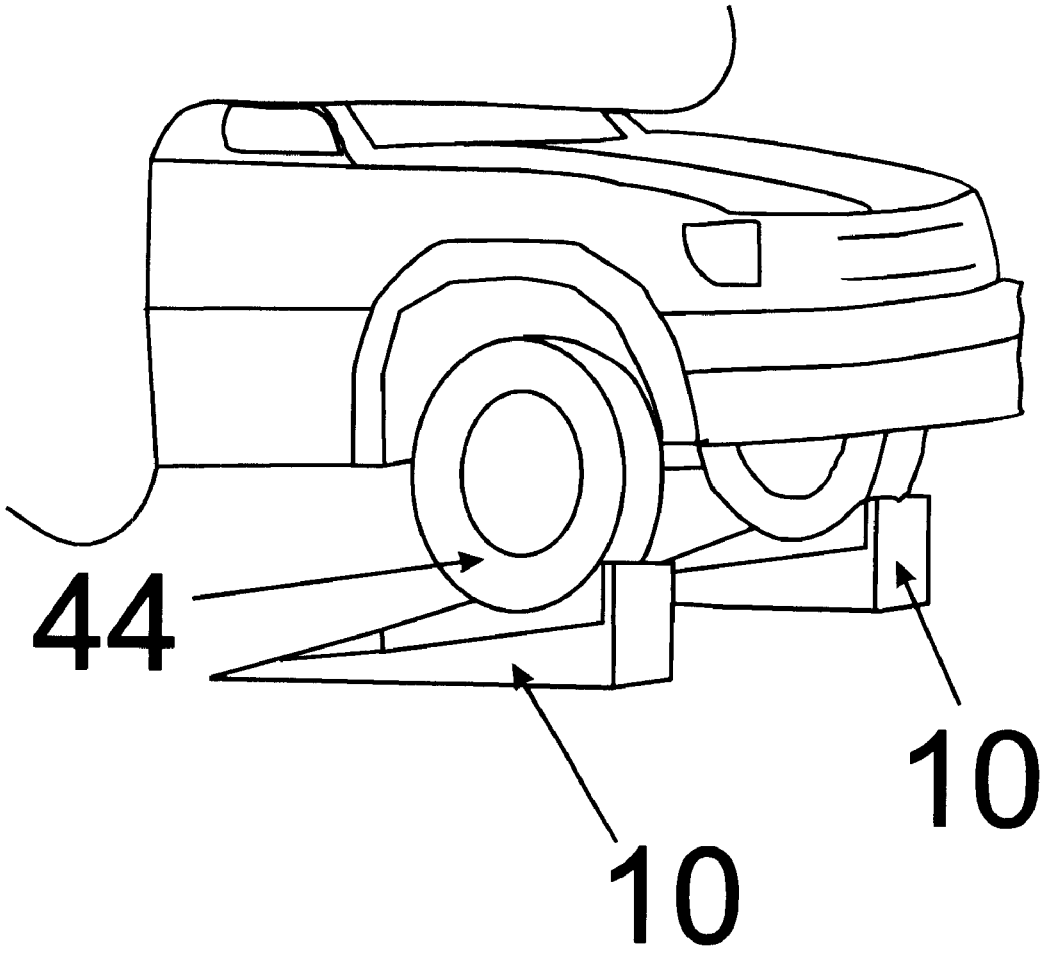
FIG. 7 shows the tire support system of the present invention with the front tires of a vehicle properly placed and supported by the contoured surface of the contour block of the system of the present invention.

FIGS. 1 through 7 show various aspects of an exemplary embodiment of the vehicle tire saver system of the present invention generally designated 10. Vehicle tire saver system 10 includes a tire saver device including an elevation block 12, a contour block 14, a ramp tip lock 16 and incline block 18. Contour block 14 and ramp tip block 16 each have zig zag bottom surfaces 22 that are adapted to engage and grip the zig zag upper surface 24 of incline block 18. Elevation block 12 includes a ramp tip portion 28 and a planar end surface portion 30 having a number of spaced upwardly projecting pegs 32 that are insertable into a like number of apertures 38 provided in the bottom of incline block 18. Contour block 14 is provided with a curved contoured surface 40 that is selected to match the size and shape of a particular tire 44 of a vehicle such that the weight of the tire is evenly spread along a curved contoured surface 40 instead of a flat floor surface. Use of the contoured surface 40 minimizes the detrimental effects of storage on the tires because it minimizes disfigurement of the side walls of the tires during storage period which can result in dry rot. As shown in FIG. 7 vehicle tire saver system 10 can be used to lift the front of the vehicle when performing maintenance such as oil changes or the like.

It can be seen from the preceding description that a vehicle tire saver system has been provided.

It is noted that the embodiment of the vehicle tire saver system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A vehicle tire saver system that is adapted for providing a contoured surface for supporting the bottom section of a tire during storage periods to prevent dry rot of the tire; the tire saver system comprising:

an elevation block;

an incline block;

a contour block, and a ramp tip block;

the contour block and the ramp tip block having zig zag cut bottoms that are adapted to engage a zig zag cut top surface of the incline block;

the elevation block including a ramped tip portion and a planar end surface having a number of pegs projecting upwardly therefrom that are adapted, spaced and sized to seat into a similar number of apertures provided in a bottom of the incline block;

the contour block being provided with a contoured tire seating surface that is sized and shaped for a particular size tire to provide an exact round fit for supporting the tire uniformly to prevent disfigurement of the tire due to gravity and eliminate or minimize the detrimental effects of storage on the tire.

* * * * *